US007036473B1

(12) United States Patent
Goracy

(10) Patent No.: US 7,036,473 B1
(45) Date of Patent: May 2, 2006

(54) ADJUSTABLE CAM SHAFT

(76) Inventor: Grant Goracy, 23944 Highway. 44, Millville, CA (US) 96062

( * ) Notice: Subject to any disclaimer, the term of this patent is extended or adjusted under 35 U.S.C. 154(b) by 80 days.

(21) Appl. No.: 10/686,113

(22) Filed: Oct. 14, 2003

(51) Int. Cl.
*F01L 1/02* (2006.01)

(52) U.S. Cl. ..... 123/90.27; 123/90.17; 123/90.6; 29/888.1

(58) Field of Classification Search .. 123/90.15–90.18, 123/90.27, 90.6, 90.31; 92/121, 122; 74/53–55, 74/567, 568 R, 568; 464/1, 2, 160; 29/888.1
See application file for complete search history.

(56) References Cited

U.S. PATENT DOCUMENTS 4,917,058 A * 4/1990 Nelson et al. ..... 123/90.17
5,253,546 A * 10/1993 Elrod et al. ..... 74/567
5,855,190 A * 1/1999 Matsunaga ..... 123/90.17
6,289,764 B1 * 9/2001 Smith et al. ..... 123/179.18
6,343,581 B1 * 2/2002 Suzuki ..... 123/90.17
6,539,906 B1 * 4/2003 Rado et al. ..... 123/179.18
6,725,817 B1 * 4/2004 Methley et al. ..... 123/90.17

* cited by examiner

*Primary Examiner*—Thomas Denion
*Assistant Examiner*—Ching Chang
(74) *Attorney, Agent, or Firm*—Kelly Lowry & Kelley, LLP

(57) ABSTRACT

An adjustable cam shaft includes an elongated shaft which may include multiple shaft sections rotatably coupled to one another. Intake and exhaust cam lobes are carried by the one or more shafts and are selectively rotatable relative to one another and selectively locked in place relative to one another in order to adjust a displacement angle between the cam lobes to alter intake and exhaust timing and other engine characteristics without the need to replace the cam shaft.

30 Claims, 5 Drawing Sheets

74
10
120,132
130
82
100
132
106
96
98
90
80
84
138
126
102
122
104
116
118
120
88
94
86
92
110
124
128
76
78

ADJUSTABLE CAM SHAFT

BACKGROUND OF THE INVENTION

The present invention generally relates to cam shafts of combustible engines and the like. More particularly, the present invention relates to an adjustable cam shaft which enables intake and exhaust timing to be altered without the need to replace the cam shaft.

The cam shaft itself is an age-old mechanical device that converts rotary motion to linear motion. The cam shaft opens and closes intake and exhaust valves to let the air/fuel mixture into the cylinder and the exhaust out. The cam shaft includes lobes which lift the valves. The taller and the greater the diameter of the lobes, the higher and longer it will lift the valves, allowing more air/fuel into the engine and more exhaust out, both of which should make the engine run better. The height of the lobe, or the distance it opens the valve, is known as lift and is given in thousandths of an inch. The width or fatness of the lobe determines the amount of time (relative to the crank shaft cycle) it will keep the valve open and is known as duration and is given in degrees of crank shaft rotation.

However, optimizing the performance of the engine is not so simple and many variables, including timing, must be taken into account. The amount of time, the intake and exhaust valves are closed, thus sealing the cylinder, determines how long pressure pushes on the piston. The point at which the intake valve closes and the point at which the exhaust valve opens are both critical to making power in the engine. These are just two of the timing events that can be altered on a cam shaft. When the intake valve opens, time is required to get the column of air in the ports to start flowing through it. Although the exhaust has a similar problem, it is to a much lesser degree because the cylinder is pressurized when the exhaust valve opens.

While the RPM of the engine increases, the "lag time" of the intake charge tends to remain the same and its momentum will keep it flowing into the cylinder even at the end of the intake stroke if the intake valve is kept open a little longer. Therefore, as an engine runs faster and faster, the cam shaft timing should occur later and later to keep pace with the air/fuel charge, which gets moving slower and keeps moving longer relative to engine speed.

There are three basic ways to alter cam shaft timing or tuning: lobe profile, lobe separation and the cam shaft installation position. In the past, the first two have been determined when the cam is manufactured and have not been able to be adjusted or varied without regrinding the cam shaft. Thus, in the past, a manufacturer or engine owner had to decide which operating range he or she wanted to optimize in the engine and select a cam shaft that would optimize air flow and cylinder pressure in that range. The problem exists that once the cam shaft is selected and installed, it optimizes one driving range, not others.

A cam shaft is typically installed in the engine relative to the crank/piston position and if one "lines up the dots" on the crank and cam timing gears, the number one cylinder is at top dead center, and the cam will be positioned near the middle of overlap for that cylinder. If the cam shaft is moved ahead in relation to the crank/position timed piston timing, it has been advanced, and if it is moved back, it is referred to as being retarded.

The lobe profile is the size and shape of the cam lobe, which determines how high and how long the valve opens, and is determined when the cam is manufactured. The lobe separation angle, also known as the lobe center line displacement angle, is the angle between the center line of the intake lobe and the center line of the exhaust lobe for one cylinder, as measured on the cam. That is, the timing of the intake lobe relative to the exhaust lobe is determined by the placement of the lobes on the cam shaft. The standard lobe separation angle is 110°, and in the past has been determined upon manufacturing of the cam shaft. When a cam shaft is manufactured, it can be ground with a "narrower", e.g. 108° or 106°, or "wider", 112° or 114° lobe separation. In the past, once these have been ground, they have been set and unalterable. The relative camshaft to crankshaft timing is dependent in regards to narrowing or widening of the lobe separation angles which directly affects the intake and or exhaust valve to open or close sooner. Widening the lobe centerline displacement angle provides increased torque, maintains idle quality, helps lowers emissions and increases vacuum for accessories such as power brakes. For racing applications a decreased lobe separation angle and advanced cam timing increases higher RPMs and horsepower numbers.

It would be desirable to alter the lobe separation displacement angle depending upon the intended performance use of the engine. For example, if the engine were to be used in a tow vehicle or motor home application, increased torque would be desirable. However in a race car setting, idle quality and low vacuum response may not be as important as high RPMs would come into play and, thus the lobe separation value would be ground closer. Accordingly there is a continuing need for an adjustable cam shaft which enables valve timing, and particularly the lobe separation angle, to be selectively adjusted. The present invention fulfills these needs and provides other related advantages.

SUMMARY OF THE INVENTION

The present invention resides in an adjustable cam shaft which allows the displacement angle between cam lobes to be altered without the need to replace the cam shaft, thus allowing intake and exhaust timing to be altered to meet the intended performance of the engine for given conditions. Generally, the adjustable cam shaft of the present invention comprises an elongated shaft having a first cam lobe carried by the shaft, and a second lobe carried by the shaft. The first and second cam lobes are selectively rotatable relative to one another and selectively locked in place relative to one another, allowing the displacement angle between the cam lobes to be selectively adjusted.

In one embodiment, the cam lobes, which comprise intake cam lobes associated with intake valves of an engine, and exhaust lobes associated with exhaust valves of an engine, are carried by an elongated shaft. The shaft is attached to a drive/timing gear assembly which includes a gear and hub. An inner shaft may extend through the elongated shaft for attachment to an engine block.

Indicia are associated with each of the cam lobes for determining the displacement angle between the cam lobes as they are rotated and adjusted relative to one another. Means for locking the cam lobes to the shaft, and relative to one another, are provided. Such locking means may comprise a locking nut threadably received onto the shaft, such that a shoulder on an opposite end of the shaft compresses the cam lobes against the drive/gear assembly so as to lock the cam lobes relative to one another. A pin may also be insertable through a drive/gear assembly and either into the first or second cam lobe for setting the position of the cam lobe relative to the drive/gear assembly.

In another embodiment, the elongated shaft comprises multiple shaft sections, each shaft section having at least one cam lobe extending therefrom. For example, a first shaft section may have either an intake or exhaust cam lobe extending therefrom, and a second shaft section may have an intake or exhaust cam lobe extending therefrom and which is rotatable with respect to the first shaft section. Means are provided for locking the first and second shaft sections relative to one another.

The first shaft section includes a shaft extending therefrom, and the second shaft section includes a hollow sleeve extending therefrom configured to accept the shaft therein such that the first and second shaft sections are rotatably associated with one another. The first shaft section includes degree indicia which are linable with degree indicia of the second shaft section to determine the relative displacement angle of the cam lobes. The first and second sections include hollow, internally threaded portions that receive an externally threaded bolt fastener that locks the first and second sections relative to one another once the desired displacement angle of the lobes has been achieved by rotating the shaft sections. A timing gear is attached to an end of the cam shaft for driving the cam shaft.

Thus, the invention allows the timing of the intake lobe relative to the exhaust lobe to be adjusted without replacement of the entire cam shaft. In fact, the timing of each lobe for each valve between the various cylinders of the combustible engine can be variable and fine-tuned to meet the performance requirements of the engine.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2:
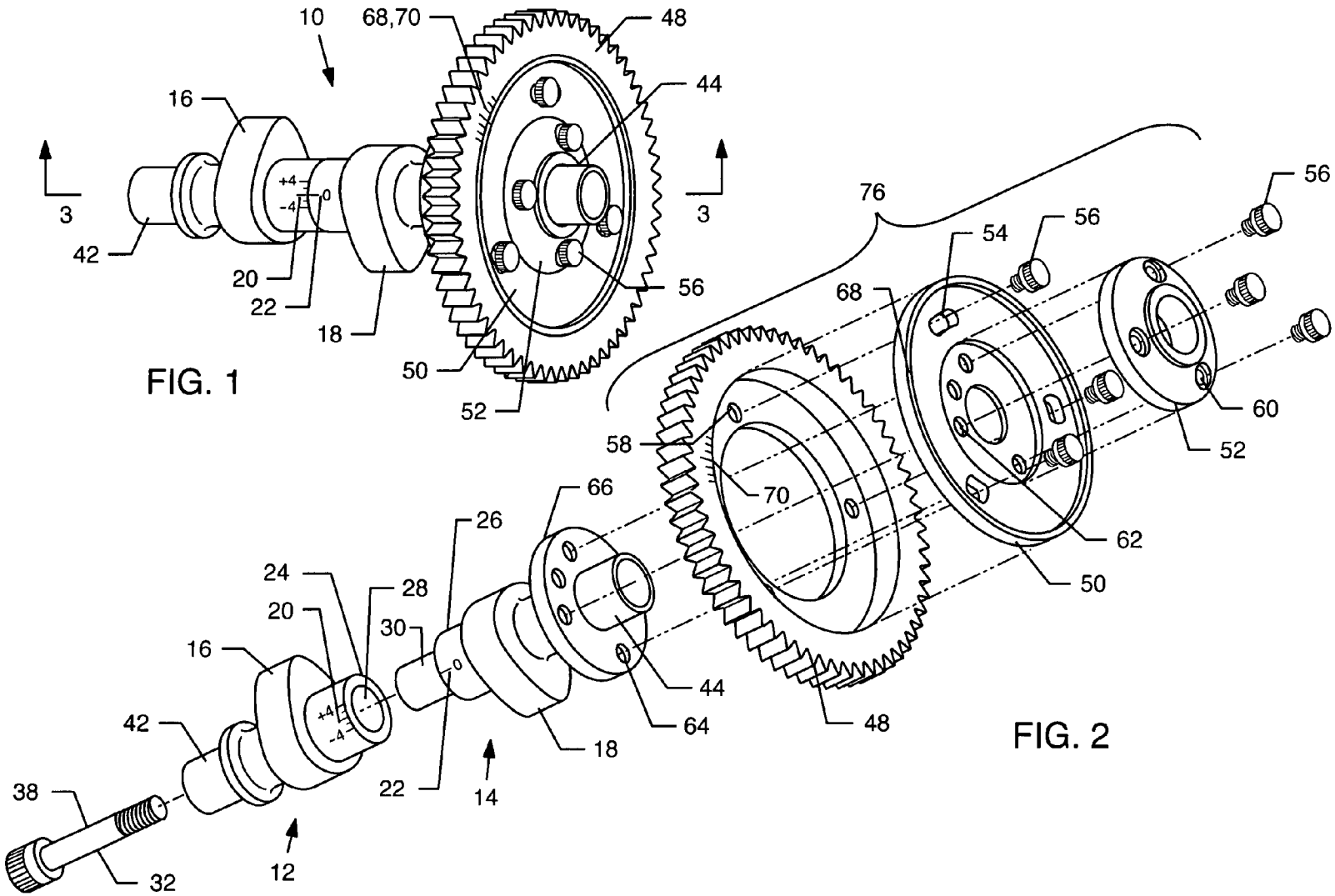
FIG. 1 is a perspective view of an adjustable cam shaft attached to a timing gear in accordance with the present invention.
FIG. 2 is an exploded perspective view of the cam shaft and timing gear of FIG. 1.

As shown in the accompanying drawings for purposes of illustration, the present invention resides in an adjustable cam shaft for use in an engine which enables the characteristics of the engine, including intake and exhaust timing, to be altered without the need to replace the cam shaft as has been done in the past.

With reference now to FIGS. 1–4, a first embodiment of the adjustable cam shaft invention is illustrated. The cam shaft 10 is comprised of two or more cam shaft sections 12 and 14 each of which has a cam lobe 16 and 18 extending therefrom. In the accompanying drawings, the present invention is illustrated as it pertains to a single piston engine, such as those used in go cart racing and the like. Accordingly, such cam shafts 10 only include a single intake cam lobe 16 or 18 and a single exhaust cam lobe 16 or 18 to actuate the associated intake and exhaust valves of the engine. However, it will be readily understood by those skilled in the art that the concepts and benefits of the present invention can be applied to any engine or any number of pistons in which intake and exhaust valves are used and in which benefits of altering the displacement angle between the cam lobes can be achieved. The cam lobes 16 and 18 may be ground with the shaft section 12 and 14, pressed onto each cam shaft section 12 and 14, or attached by any other known means. Each shaft section 12 and 14 includes markings or other indicia 20 and 22 which allows a mechanic to determine the amount of offset in adjustment of the center line of the cam lobes 16 and 18 with respect to one another. Thus, the displacement angle between the center lines of the cam lobes 16 and 18 can be easily seen and adjusted as the shaft section 16 and 18 are rotatable with respect to one another.

As illustrated in FIGS. 1 and 2, the first shaft section 16 includes a shoulder 24 which is configured to abut and end-to-end with a shoulder 26 of the second shaft section 14, thus allowing alignment of the indicia 20 and 22, as described above. The first shaft section 12 includes an aperture 28 which extends therethrough and which is configured to receive a protruding shaft or neck 30 therein so as to couple the first and second sections 12 and 14 to one another.

Figure 3:
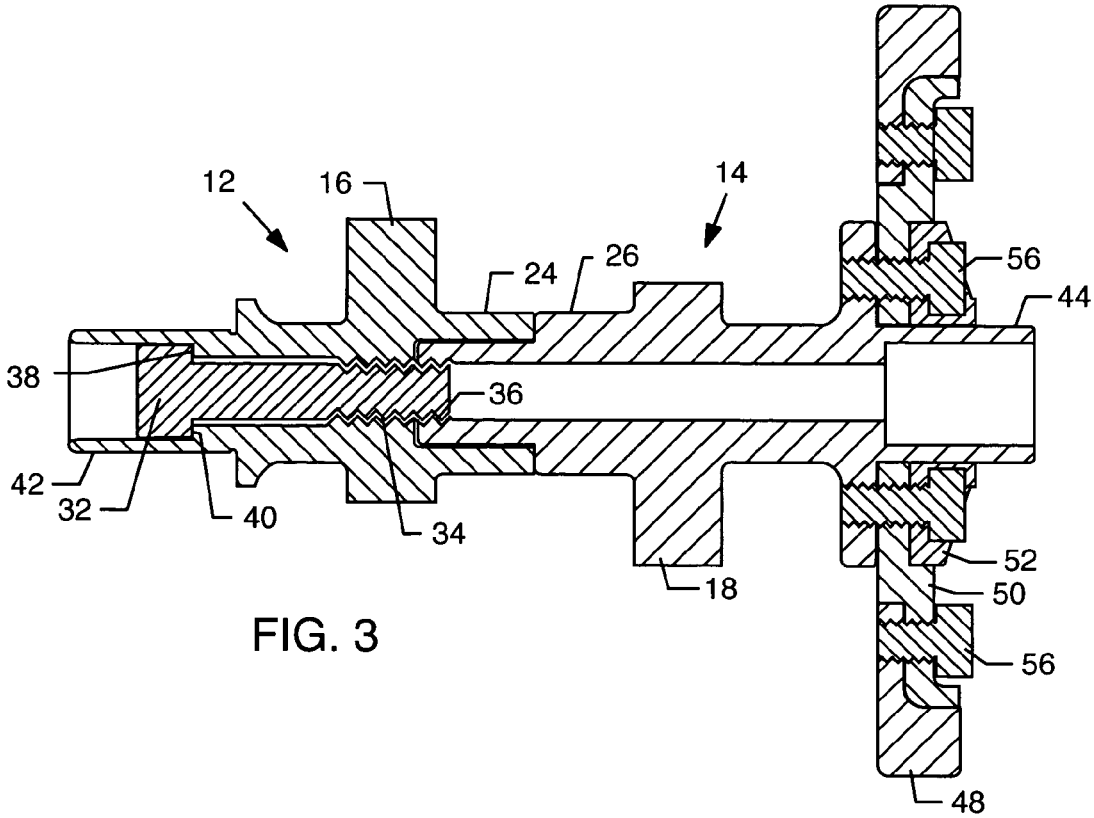
FIG. 3 is a cross-sectional view taken generally along lines 3—3 of FIG. 1, illustrating sections of the cam shaft locked in place relative to one another.
Figure 4:
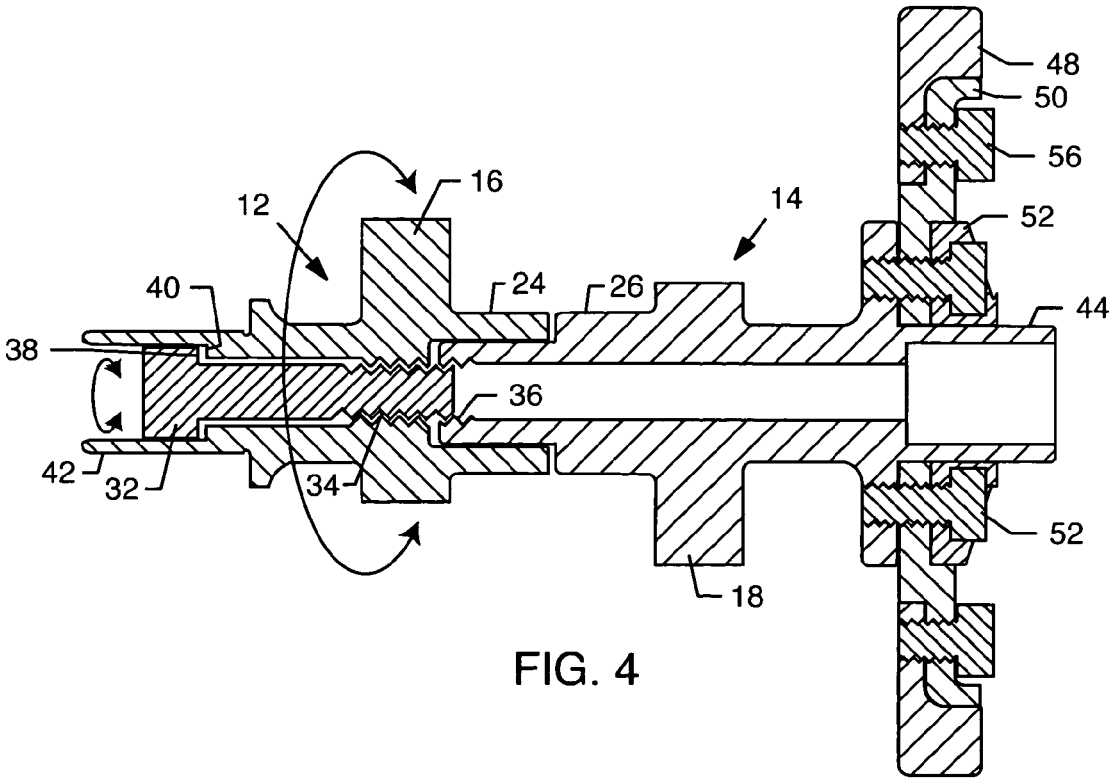
FIG. 4 is a cross-sectional view similar to FIG. 3, illustrating the sections rotatable relative to one another.
Figures 5, 6:
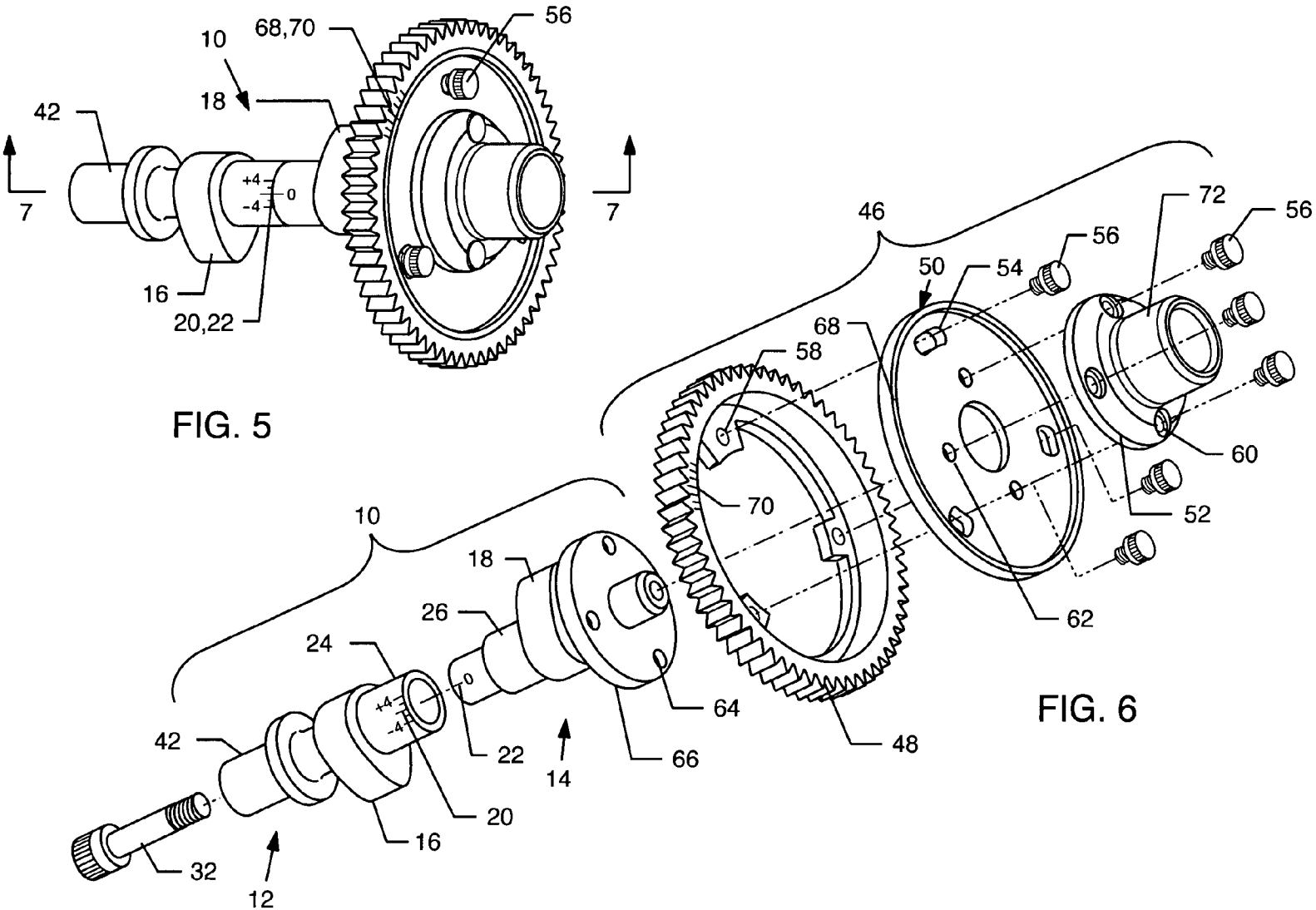
FIG. 5 is a perspective view of the adjustable cam shaft of the present invention attached to another timing gear assembly.
FIG. 6 is an exploded perspective view of the cam shaft and timing gear assembly of FIG. 5.
Figure 7:
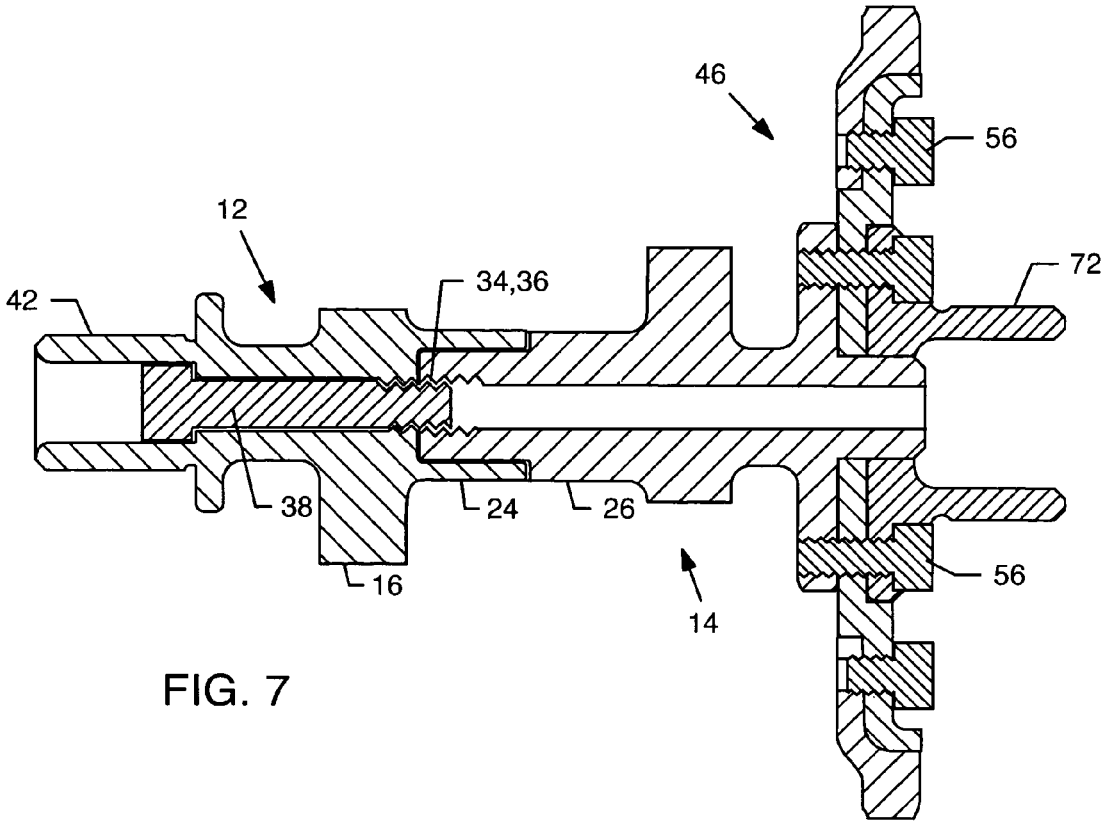
FIG. 7 is a cross-sectional view of the cam shaft and timing gear assembly taken generally along line 7—7 of FIG. 5.
Figure 8:
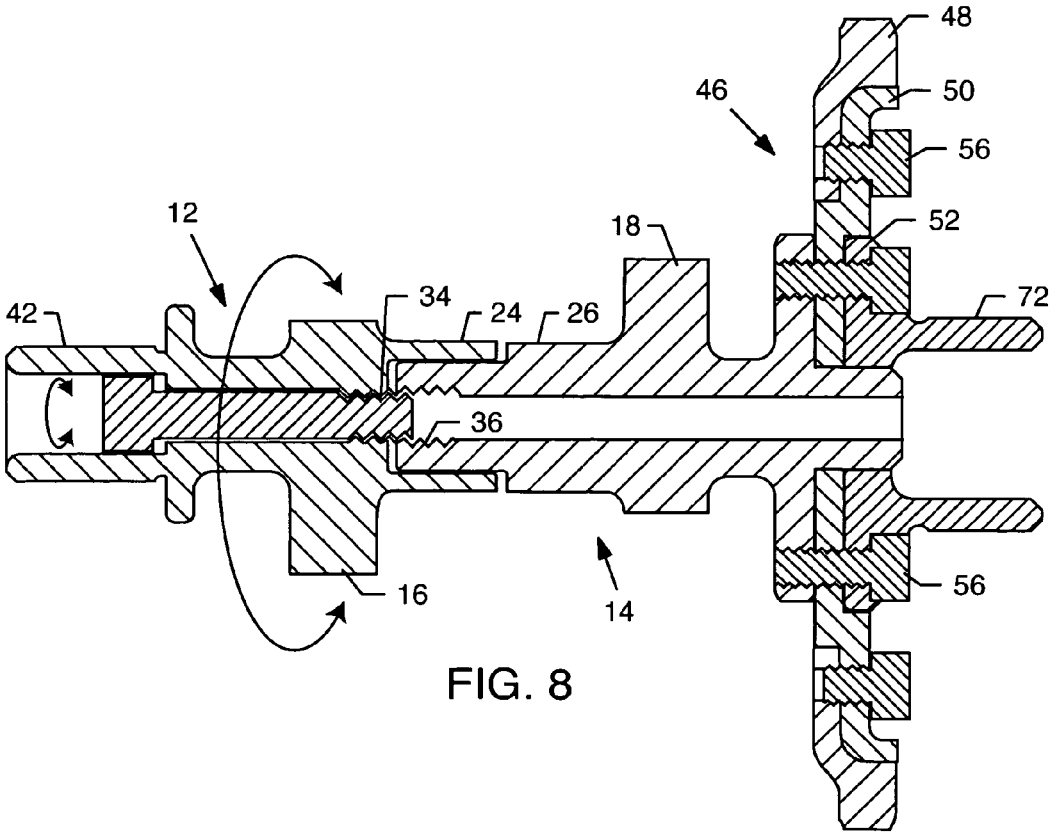
FIG. 8 is a cross-sectional view similar to FIG. 7, illustrating cam shaft sections unlocked, allowing the rotation of the sections relative to one another.

With reference now to FIGS. 3 and 4, means are provided to enable the first and second shaft sections 12 and 14 to rotate relative to one another and be selectively locked in place. One such means is the use of a threaded fastener 32 which is inserted through the hollow first shaft section 12 such that it engages internal threads 34 and 36 until a head 38 of the fastener contacts an internal shoulder 40, or otherwise fastens the first and second shaft sections 12 and 14 to one another so that they are not able to freely and independently rotate with respect to one another. To adjust the lobe center line angle, the fastener 32 is loosened until the first shaft section 12 is able to freely rotate about the second shaft section end 14, as illustrated in FIG. 4. Once the desired displacement angle has been achieved, the fastener 32 is tightened until it engages both the internal threads 34 and 36 of both shaft sections 12 and 14, resulting in the shaft sections 12 and 14 being locked with respect to one another.

In the embodiment illustrated in FIGS. 1–4, opposite ends 42 and 44 of the first and second shaft sections 12 and 14, respectively, serve as bearing shafts or surfaces which engage sleeves of the engine block, or other pertinent structure, to allow the shaft 10 to rotate with minimal friction.

The cam shaft 10 is operably coupled to a drive/gear assembly 46 which includes a drive gear 48, a hub 50, and an associated thrust washer 52. The gear attachment hub 50 includes apertures or slots 54 through which lock down fasteners 56 extend into a corresponding threaded aperture 58 in the drive/gear 48. FIGS. 1 and 2 illustrate three corresponding slots 54 and apertures 58 to enable the secure connection between the drive gear 48 and hub 50. The thrust washer 52 includes apertures 60 which are alignable with apertures 62 in the hub 50 and apertures 64 of a hub flange or shoulder 66 which engages the hub 50. The insertion of the lock down fasteners 56 through the thrust washer 52, hub 50 and into the shoulder 66 of the shaft 10 secures the shaft to the drive/gear assembly 46. This enables the belt, chain, or other means which engages the drive/gear 48 to rotate the cam shaft 10. The hub 50 includes a locating marker 68 which is alignable with indicia 70 on the gear 48 in order to allow the cam shaft 10 to be on dead center, advanced or retarded upon installation, in standard practice. Such alignment of the cam shaft 10 is done independently of the positioning of the cam lobes 16 and 18. Thus, a mechanic is able not only to retard or advance the entire cam shaft 10, but also adjust the timing of the intake and exhaust valves by rotating the cam lobe 16 and 18 with respect to one another, as described above. Thus, a mechanic or owner of the engine can adjust the torque, idle quality, and other characteristics of the engine without the need to replace the entire cam shaft 10 as has previously been the case.

With reference now to FIGS. 5–8, another cam shaft assembly is shown in which the various components of the cam shaft 10 and drive/gear assembly 46 are in common. However, to accommodate various engine types, the thrust washer 52 includes an elongated bearing surface structure 72 which serves as the rotating connection point between the cam shaft assembly and the engine block or other pertinent structure of the engine. Thus, the end 44 of the second shaft section merely rests within the elongated outer bearing surface structure 72 in this particular engine design. However, the primary concepts of altering the cam lobe center lines by rotatably adjusting the cam lobes 16 and 18 with respect to one another remain the same as described above.

Figures 9, 10, 11:
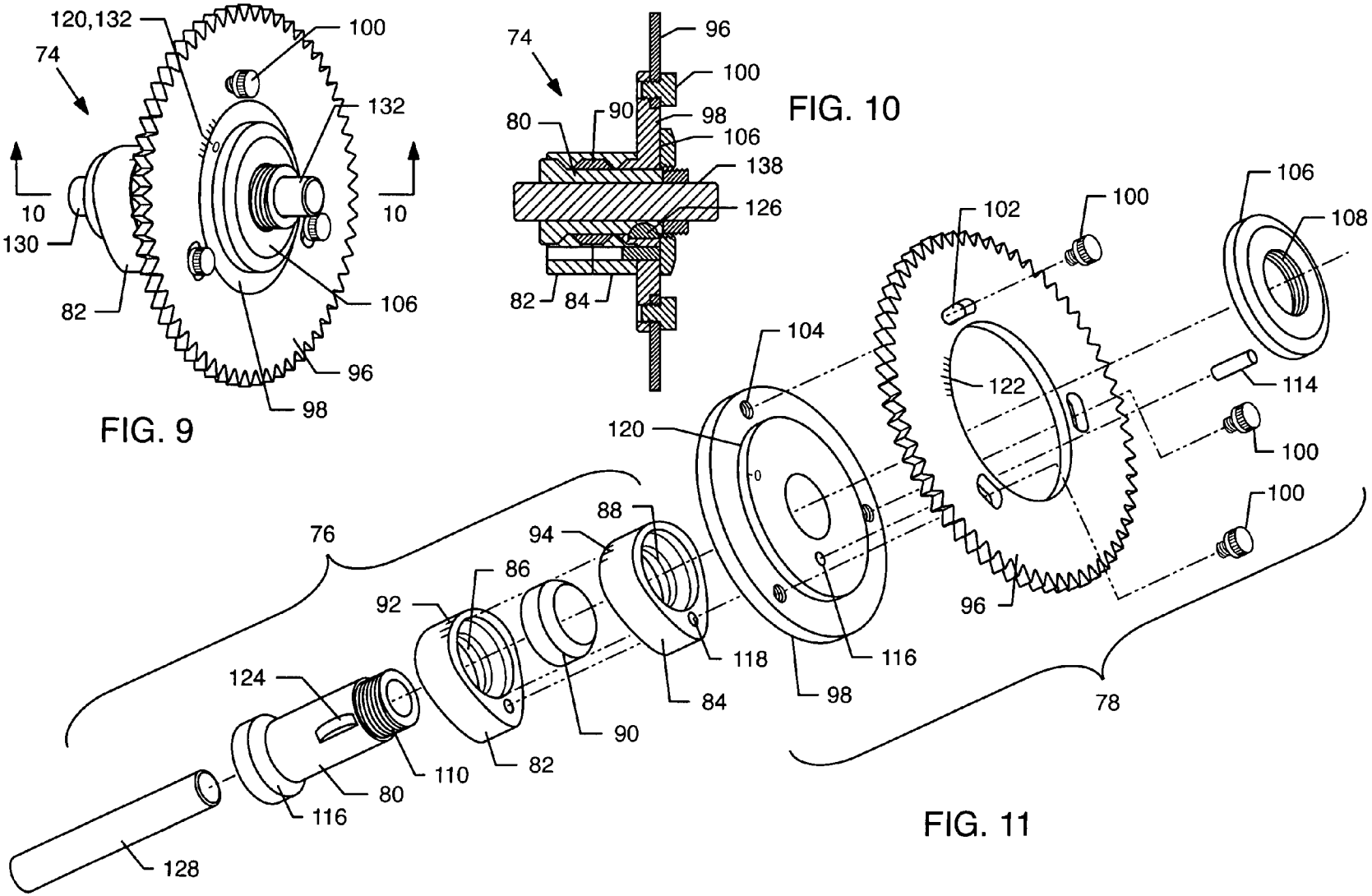
FIG. 9 is a perspective view of another adjustable cam shaft embodying the present invention.
FIG. 10 is a cross-sectional view taken generally along line 10—10 of FIG. 9.
FIG. 11 is an exploded perspective view of the cam shaft and timing gear assembly of FIG. 9.

With reference now to FIGS. 9–11, in some engines, particularly of the single piston design by certain manufacturers, a single cam lobe shaft design is implemented wherein a single cam lobe extends across rods of the intake and exhaust valves. It is the rods or rocker arms of the intake and exhaust valves that are offset during the manufacture of the engine to coincide with the single, and typically enlarged, cam lobe. The present invention allows one to increase torque, adjust idle quality, or otherwise adjust the intake and exhaust timing by separating a single cam lobe into multiple lobes, as will be herein described. The entire cam shaft and gear train assembly 74 is illustrated in FIG. 9 in its assembled state. The assembly comprises a cam shaft assembly 76 and a drive/gear train assembly 78. The cam shaft assembly 76 includes an elongated shaft 80 upon which two or more cam lobes 82 and 84 are carried and which comprise intake and exhaust cam lobes. In a particularly preferred embodiment, the cam lobes 82 and 84 include central apertures 86 and 88 through which the elongated shaft 80 is inserted. A non-sliding bushing or spacer 90 is configured to be received in the adjoining cam lobes 82 and 84 such that the cam lobes 82 and 84 are rotatable with respect to one another, yet disposed end-to-end to create the equivalent of a single cam lobe. The cam lobes 82 and 84 include indicia 92 and 94 thereon which are alignable and which assist in the discrimination of the displacement angle of the center line of the cam lobes 82 and 84. Typically, the non-sliding bushing 90 includes opposing shoulders of reduced cross-sectional dimension which nest within mating recesses formed in the cam lobes 82 and 84.

The cam lobes 82 and 84 are typically symmetrical and substantially equivalent at least with respect to the central aperture 86 and 88 and the recesses therein. This enables a manufacturer to mass produce the cam lobes 82 and 84, or at least produce batches of identical cam lobes which can then be associated with other cam lobes of other batches, thus simplifying the manufacturing process resulting in a higher profit margin or lower product cost. This is very different than the current method of producing a particular cam shaft for an engine with the profile of each cam lobe being fixed and unalterable as the cam shaft is ground or otherwise formed.

The drive/gear train assembly 78 includes a toothed sprocket 96, or other gear as is necessary in order to engage the associated chain, pulley, etc. for rotating the assembly 74. The sprocket 96 is coupled to a secondary hub 98 with the use of lock fasteners 100 or the like which are inserted through slots or apertures 102 of the sprocket 96 and into threaded apertures of the hub 98. The sprocket 96 and hub 98 are operatively coupled to the cam shaft assembly 76 by tightening a locking nut 106 having internal threads 108 onto an exteriorally threaded end 110 of the shaft 80. Tightening the locking nut 106 on the elongated shaft 80 causes a shoulder 112 of the shaft 80 to compress the cam lobes 82 and 84, non-sliding bushing 90, hub 98 and sprocket 96 against one another to form a very tight fit. A pin 114 or the like extends through a corresponding aperture 116 in the hub 98 and into a corresponding aperture 118 of the adjacent cam lobe 84 for initial setting purposes. Indicia 120 on the hub 98 can then be aligned with corresponding indicia 122 on the sprocket or gear 96 in order to achieve dead center, advancement, or retardation of the overall cam shaft assembly. As discussed above, this does not limit in any way the displacement angle alternatives between the cam lobes 82 and 84, which are rotated independently upon the loosening of the locking nut 106. The elongated shaft 80 may include a keyhole 124 which accepts a key 126 such that the shaft 80 and hub 98 are coupled to one another, as will be appreciated by those skilled in the art. In the illustrated embodiment, an inner elongated shaft 128 extends through the hollow elongated shaft 80 so as to have end bearing surfaces 130 and 132 which engage with the necessary components of the engine to allow the assembly 74 to rotate under the force of the chain or pulley acting upon the sprocket 96. Alternatively, the elongated shaft 80 could include such bearing surfaces extending from either end thereof beyond the shoulder 112 and the threaded portion 110 to achieve the same results.

It will thus be appreciated by those skilled in the art that the present invention enables the adjustment of the center line of the cam lobes with respect to one another in order to alter the characteristics of the engine such as torque or idle by adjusting the timing of the exhaust and intake valves without the need to remove the existing cam shaft and replace it with another whose lobes are machined or positioned to accommodate such desired characteristics. Instead, the present invention enables the rotation and positioning of the lobes by loosening a locking or tightening means, rotating the lobe in question, and retightening the assembly. Thus, the timing of the intake and exhaust valves can be altered to accommodate for different weather conditions, idle, torque, etc. as needed. Such is particularly useful in racing conditions, such as Go-Kart racing, where such conditions can vary from geographic location and also time of year or even time of day. The present invention also enables the mass manufacture of cam lobes or cam shaft sections which can be assembled according to user need, thus resulting in lower manufacturing costs.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. An adjustable cam shaft, comprising:

an elongated shaft;

a first cam lobe carried by the shaft;

a second cam lobe carried by the shaft;

wherein the first and second cam lobes are selectively rotatable relative to one another and selectively locked in place relative to one another, whereby a displacement angle between the cam lobes can be selectively adjusted; and means for locking the first and second cam lobes to the shaft.

2. The cam shaft of claim 1, including a drive/timing gear assembly carried by the shaft and associated with the first and second cam lobes.

3. The cam shaft of claim 2, wherein the drive/timing gear assembly includes a gear and a hub fastened to one another.

4. The cam shaft of claim 1, wherein either the first or second cam lobe comprises an intake cam lobe associated with an intake valve of an engine, and the other cam lobe comprises an exhaust lobe associated with an exhaust valve of an engine.

5. The cam shaft of claim 1, including indicia associated with each of the first and second cam lobes for determining the displacement angle of the cam lobes.

6. The cam shaft of claim 1, wherein the locking means comprises a locking nut threadedly received onto the shaft.

7. The cam shaft of claim 6, wherein the shaft includes an externally threaded portion for receiving the locking nut, and a shoulder on an opposite end thereof, whereby as the locking nut is tightened onto the shaft, the shoulder compresses the first and second cam lobes against a drive/gear assembly so as to lock the first and second cam lobes relative to one another.

8. The cam shaft of claim 7, including a pin insertable through a drive/gear assembly and into either the first or second cam lobe for setting the position of the first or second cam lobe relative to the drive/gear assembly.

9. The cam shaft of claim 1, including an inner shaft extending through the elongated shaft for attachment to an engine block.

10. The cam shaft of claim 1, wherein the elongated shaft comprises first and second shaft sections, the first cam lobe extending from the first shaft section, and the second cam lobe extending from the second shaft section, and wherein the shaft sections are rotatably associated with one another and selectively locked in place relative to one another.

11. The cam shaft of claim 10, wherein the first shaft section includes a shaft extending therefrom, and the second shaft section includes a hollow sleeve extending therefrom and configured to accept the shaft therein.

12. The cam shaft of claim 10, including means for locking the first and second shaft sections relative to one another.

13. The cam shaft of claim 12, wherein the locking means comprises a fastener attachable to the first and second shaft sections.

14. The cam shaft of claim 13, wherein the first and second shaft sections include hollow, internally threaded portions that receive the fastener.

15. An adjustable cam shaft, comprising:

a first shaft section having a cam lobe extending therefrom;

a second shaft section having a cam lobe extending therefrom; and means for locking the first and second shaft sections relative to one another;

wherein either the first or second cam lobe comprises an intake cam lobe associated with an intake valve of an engine, and the other cam lobe comprises an exhaust lobe associated with an exhaust valve of an engine; and wherein the first and second shafts are selectively rotatable relative to one another and selectively locked in place relative to one another, whereby a displacement angle between the cam lobes can be selectively adjusted.

16. The cam shaft of claim 15, including a drive/timing gear assembly comprising a gear and a hub attached to either the first or second shaft section.

17. The cam shaft of claim 15, including indicia associated with each of the first and second shaft sections for determining the displacement angle of the cam lobes.

18. The cam shaft of claim 15, wherein the first shaft section includes a shaft extending therefrom, and the second shaft section includes a hollow sleeve extending therefrom and configured to accept the shaft therein.

19. The cam shaft of claim 15, wherein the first and second shaft sections include hollow, internally threaded portions, and wherein the locking means comprises a fastener received within the first and second shaft sections.

20. An adjustable cam shaft, comprising:

an elongated shaft;

a first cam lobe carried by the shaft;

a second cam lobe carried by the shaft; and means for locking the first and second cam lobes to the shaft;

wherein either the first or second cam lobe comprises an intake cam lobe associated with an intake valve of an engine, and the other cam lobe comprises an exhaust lobe associated with an exhaust valve of an engine; and wherein the first and second cam lobes are selectively rotatable relative to one another and selectively locked in place relative to one another, whereby a displacement angle between the cam lobes can be selectively adjusted.

21. The cam shaft of claim 20, including a drive/timing gear assembly comprising a gear and hub carried by the shaft and associated with the first and second cam lobes.

22. The cam shaft of claim 20, including indicia associated with each of the first and second cam lobes for determining the displacement angle of the cam lobes.

23. The cam shaft of claim 20, wherein the locking means comprises a locking nut threadedly received onto the shaft.

24. The cam shaft of claim 23, wherein the shaft includes an externally threaded portion for receiving the locking nut, and a shoulder on an opposite end thereof, whereby as the locking nut is tightened onto the shaft, the shoulder compresses the first and second cam lobes against a drive/gear assembly so as to lock the first and second cam lobes relative to one another.

25. The cam shaft of claim 24, including a pin insertable through a drive/gear assembly and into either the first or second cam lobe for setting the position of the first or second cam lobe relative to the drive/gear assembly.

26. The cam shaft of claim 20, including an inner shaft extending through the elongated shaft for attachment to an engine block.

27. An adjustable cam shaft, comprising:

an elongated shaft;

a first cam lobe carried by the shaft; and a second cam lobe carried by the shaft;

wherein the first and second cam lobes are selectively locked in place relative to one another, whereby a displacement angle between the cam lobes can be selectively adjusted;

wherein the elongated shaft comprises first and second shaft sections, the first cam lobe extending from the first shaft section, and the second cam lobe extending from the second shaft section, and wherein the shaft sections are rotatably associated with one another and selectively locked in place relative to one another; and wherein the first shaft section includes a shaft extending therefrom, and the second shaft section includes a hollow sleeve extending therefrom and configured to accept the shaft therein.

28. An adjustable cam shaft, comprising:

an elongated shaft;

a first cam lobe carried by the shaft; and a second cam lobe carried by the shaft;

wherein the first and second cam lobes are selectively locked in place relative to one another, whereby a displacement angle between the cam lobes can be selectively adjusted;

wherein the elongated shaft comprises first and second shaft sections, the first cam lobe extending from the first shaft section, and the second cam lobe extending from the second shaft section, and wherein the shaft sections are rotatably associated with one another and selectively locked in place relative to one another; and means for locking the first and second shaft sections relative to one another.

29. The adjustable cam shaft of claim 28, wherein the locking means comprises a fastener attachable to the first and second shaft sections.

30. The cam shaft of claim 29, wherein the first and second shaft sections include hollow, internally threaded portions that receive the fastener.

* * * * *